US007825876B2

(12) United States Patent
Otawara et al.

(10) Patent No.: US 7,825,876 B2
(45) Date of Patent: Nov. 2, 2010

(54) PLASMA DISPLAY PANEL BRIGHTNESS CORRECTION CIRCUIT AND METHOD, AND PLASMA DISPLAY PANEL VIDEO DISPLAY DEVICE AND METHOD

(75) Inventors: Masayuki Otawara, Yokohama (JP); Hidehito Ogawa, Yokohama (JP)

(73) Assignee: Samsung SDI Co., Ltd., Yongin-si (KR)

( * ) Notice: Subject to any disclaimer, the term of this patent is extended or adjusted under 35 U.S.C. 154(b) by 965 days.

(21) Appl. No.: 10/913,687

(22) Filed: Aug. 5, 2004

(65) Prior Publication Data

US 2005/0052364 A1 Mar. 10, 2005

(30) Foreign Application Priority Data

Aug. 8, 2003 (JP) ..... 2003-290354

(51) Int. Cl.
*G09G 3/28* (2006.01)

(52) U.S. Cl. ..... 345/63

(58) Field of Classification Search ..... 345/60–64, 345/690; 315/169.4

See application file for complete search history.

(56) References Cited

U.S. PATENT DOCUMENTS

| | | | | |
|---|---|---|---|---|
| 5,757,343 | A * | 5/1998 | Nagakubo | 345/63 |
| 6,414,295 | B1 * | 7/2002 | Nakamura | 250/208.1 |
| 6,476,824 | B1 * | 11/2002 | Suzuki et al. | 345/690 |
| 6,650,307 | B1 * | 11/2003 | Toda et al. | 345/63 |
| 6,894,666 | B2 * | 5/2005 | Otawara et al. | 345/77 |
| 7,113,227 | B1 * | 9/2006 | Kakuya et al. | 348/678 |
| 2001/0035850 | A1 * | 11/2001 | Okamoto et al. | 345/77 |
| 2003/0122743 | A1 * | 7/2003 | Suzuki | 345/63 |
| 2003/0179162 | A1 * | 9/2003 | Ooe et al. | 345/63 |

FOREIGN PATENT DOCUMENTS

| | | |
|---|---|---|
| JP | 02-091687 A | 3/1990 |
| JP | 9-185343 | 7/1997 |
| JP | 09-185345 A | 7/1997 |
| JP | 2003-005712 A | 1/2003 |

OTHER PUBLICATIONS

Patent Abstract of Japan, Publication No. 08-185343, Published Jul. 15, 1997, in the name of Tajima, et al.

Patent Abstracts of Japan, Publication No. 09-185345; Date of Publication: Jul. 15, 1997; in the name of Hiroshi Tomitani et al.

(Continued)

*Primary Examiner*—Chanh Nguyen
*Assistant Examiner*—Allison Walthall
(74) *Attorney, Agent, or Firm*—Christie, Parker & Hale, LLP

(57) ABSTRACT

A plasma display panel brightness correction circuit, a brightness correction method, a video display, and a video display method are provided. One embodiment includes a continuity detector that receives video signals and detects those of the video signals having signal level values which are greater than or less than a predetermined value. A video signal corrector is also provided for applying correction factors. The correction factors are calculated according to the ratio of pixels with signal level values greater than the predetermined value to the pixels with signal level values less than the predetermined value. The video signal corrector then corrects the levels of the video signals.

20 Claims, 6 Drawing Sheets

OTHER PUBLICATIONS

Patent Abstracts of Japan, Publication No. 02-091687 A; Date of Publication: Mar. 30, 1990; in the name of Shiyuuji Nakamura.

Patent Abstracts of Japan, Publication No. 2003-005712; Date of Publication: Jan. 8, 2003; in the name of Koji Ogusu et al.

* cited by examiner

PLASMA DISPLAY PANEL BRIGHTNESS CORRECTION CIRCUIT AND METHOD, AND PLASMA DISPLAY PANEL VIDEO DISPLAY DEVICE AND METHOD

CROSS REFERENCE TO RELATED APPLICATION

This application claims priority to and the benefit of Japanese Patent Application No. 2003-290354 filed on Aug. 8, 2003 in the Japanese Patent Office, the entire content of which is incorporated herein by reference.

BACKGROUND (a) Field

The present invention relates to plasma display panels (PDPs) and, more particularly, to video brightness correction.

(b) Description of the Related Art

Video displays, such as the subfield type PDP, which divide images per field into a plurality of subfields ("SF"s) with predetermined weights and then display them, are known in the art. These types of video displays, however, tend to have lowered brightness when a display area of the image is increased for each subfield.

FIG. 7 shows a representative subfield sequence when 8 SFs display 256 gray scales, and the numbers correspond to the number of sustain pulses assigned during a sustain period of each SF.

The SF method tends to cause a variation in brightness as a display area on the image is increased. This occurs when the numbers of the sustain pulses, which are assigned according to the display area ratio of the images, are all the same.

FIG. 8 shows such a reduction of the brightness as the display area ratio increases. In more detail, it shows that the brightness is lowered when the area ratio is increased according to the brightness for each SF. This is due to a voltage drop generated by influences of inner impedance of a driving circuit or of wiring impedance and a driving voltage is varied. When the area ratios of the SFs are uniformly decreased, the brightness is also uniformly decreased.

However, problems occur when the area ratios of the respective SFs are substantially different. That is, since the brightness of the SF with a small area ratio is not lowered, but the brightness of the SF with a large area ratio is lowered as shown in FIG. 8, coexistence of the two cases generates different brightness levels for the respective SFs, damaging the original gray scale display characteristics.

A conventional method for sensing the area ratio for each SF, and increasing or decreasing the number of sustain pulses according to the brightness lowered ratio when the area ratio is different for each SF is disclosed by Japanese Publication Application Hei 9-185343. This reference relates to a display device for configuring display fields of one image with a plurality of subfields, weighting an emit period for each subfield, and displaying the gray scales. In this method, a correction period emission is performed by correcting the emit period so that a display load on the whole display area is calculated for each subfield, A predetermined ratio of the brightness of a display cell caused by each subfield may be provided according to the display load of each calculated subfield (refer to FIG. 9). As a result, the brightness ratio between the subfields is constantly maintained to accurately display the gray scales irrespective of differences of the display loads for the respective subfields, thereby effectively maintaining the original grayscale characteristics.

In general, discharges and emissions are generated on the PDP screen by applying sustain pulses to a combination of two electrodes arranged in horizontal rows, such as the case in which the respective combinations of the electrodes are uniformly provided on the screen.

However, when the area ratios are substantially different for the respective SFs with respect to the vertical direction on the screen, the wiring which causes degradation of the brightness is provided in the horizontal row direction. The driving circuit is also configured by dividing the wires in the row direction into a plurality of blocks. Accordingly, places where the brightness is partially degraded and places where no brightness is degraded are mixed, causing a variation in brightness across the display.

FIG. 6 shows an example of a screen that does not vary the load ratios of the SFs because it displays black, which is the lowest gray level, and white, which is the highest gray level.

However, since each row line has a different area ratio for displaying white, the brightness of a line with a large area ratio is lowered, and the brightness of a screen with a small area ratio is not lowered. A brightness difference, therefore, is generated as shown in FIG. 6 for the black and white grayscales.

SUMMARY

The present invention provides a brightness correction circuit, a brightness correction method, a video display device, and a video display method for reducing non-uniformity of display brightness.

In one embodiment of the present invention, a PDP brightness correction circuit includes a continuity detector for receiving video signals and detecting the video signals having signal level values which are consecutively greater than or less than a predetermined value. A video signal corrector is also provided for applying correction factors. In one embodiment, the correction factors are applied by multiplication. The correction factors are calculated according to the ratio of pixels with signal level values greater than the predetermined value to the pixels with signal level values less than the predetermined value. The video signal corrector then corrects the signal level values of the video signals.

The continuity detector may include a first gray level detector for determining a pixel with a signal level less than the predetermined value to be a first gray scale. The continuity detector may also include a first gray level continuity detector for receiving determination results from the first gray level detector and detecting a case in which the first gray scale is consecutive by a predetermined number of pixels. A second gray level detector may also be provided in a continuity detector for determining a pixel with a signal level greater than the predetermined value to be a second gray scale from among the input video signals and outputting determination results. The continuity detector may also include a second gray level continuity detector for receiving determination results from the second gray level detector, and detecting a case in which the second gray scale is consecutive by a predetermined number of pixels.

The first gray level continuity detector may be configured to detect a case in which the first gray scale is consecutive by a predetermined number of pixels in the horizontal direction or the vertical direction, and the second gray level continuity detector may be configured to detect a case in which the second gray scale is consecutive by a predetermined number of pixels in the horizontal direction or the vertical direction.

The first gray level continuity detector may be configured to detect a case in which the first gray scale is consecutive by a predetermined number of lines in the horizontal direction or the vertical direction. The second gray level continuity detector may also be configured to detect a case in which the second gray scale is consecutive by a predetermined number of lines in the horizontal direction or the vertical direction.

The video signal corrector can also correct the signal level value of the video signal according to a screen load ratio on the screen calculated according to the signal level of the total pixels of one field.

The correction factor may be calculated according to the ratio between pixel signal level values greater than a predetermined value and pixel signal level values less than the predetermined value, as well as the whole screen load ratio.

The correction factor may also be calculated according to a relative position of the pixel which is corrected on the screen.

The video signal corrector may correct the delayed video signal levels by the number of consecutive pixels or lines in the horizontal or vertical directions detected by the first or second gray level continuity detectors, and correct the signal level values of the delayed signals.

In another embodiment of the present invention, a PDP brightness correction method includes receiving video signals and detecting those of the video signals which are greater or less than a predetermined value for a predetermined number of consecutive pixels. The embodiment also includes applying (e.g., multiplying) correction factors which are calculated according to the ratio of pixels with signal level values greater than a predetermined value to pixels with signal level values less than the predetermined value. This embodiment further includes correcting the signal level values of the video signals.

Detecting the video signals may include determining the pixels with signal level values less than the predetermined value to have a first gray scale. It may further include receiving determination results and detecting the case in which the first gray scales are consecutive for a predetermined number of pixels. Some embodiments also include determining the pixels with signal level values greater than the predetermined value to have a second gray scale and detecting the case in which the second gray scales are consecutive for a predetermined number of pixels. One embodiment also includes detecting the pixels with signal level values greater or less than the predetermined value for a predetermined number of consecutive pixels.

Detecting the pixels may include detecting a case in which the first gray scales are consecutive in the horizontal direction or vertical direction for a predetermined number of pixels, and detecting a case in which the second gray scales are consecutive in the horizontal direction or vertical direction for a predetermined number of pixels.

Detecting the pixels may include detecting a case in which the first gray scales are consecutive in the horizontal direction or vertical direction for a predetermined number of lines, and detecting a case in which the second gray scales are consecutive in the horizontal direction or vertical direction for a predetermined number of lines.

Signal level values of the video signals may be corrected according to a screen load ratio of the screen calculated according to the signal level values of the pixels of one field.

The correction factors may additionally be calculated according to the screen load ratio.

The correction factor may be calculated according to a relative position of the pixel which is corrected on the screen.

Signal level values of the video signals which are delayed by the number of consecutive pixels or the number of consecutive lines in the horizontal direction or the vertical direction may be corrected.

In another embodiment, a display displaying video according to video signals output by the video signal corrector is also provided.

DETAILED DESCRIPTION

Figure 1:
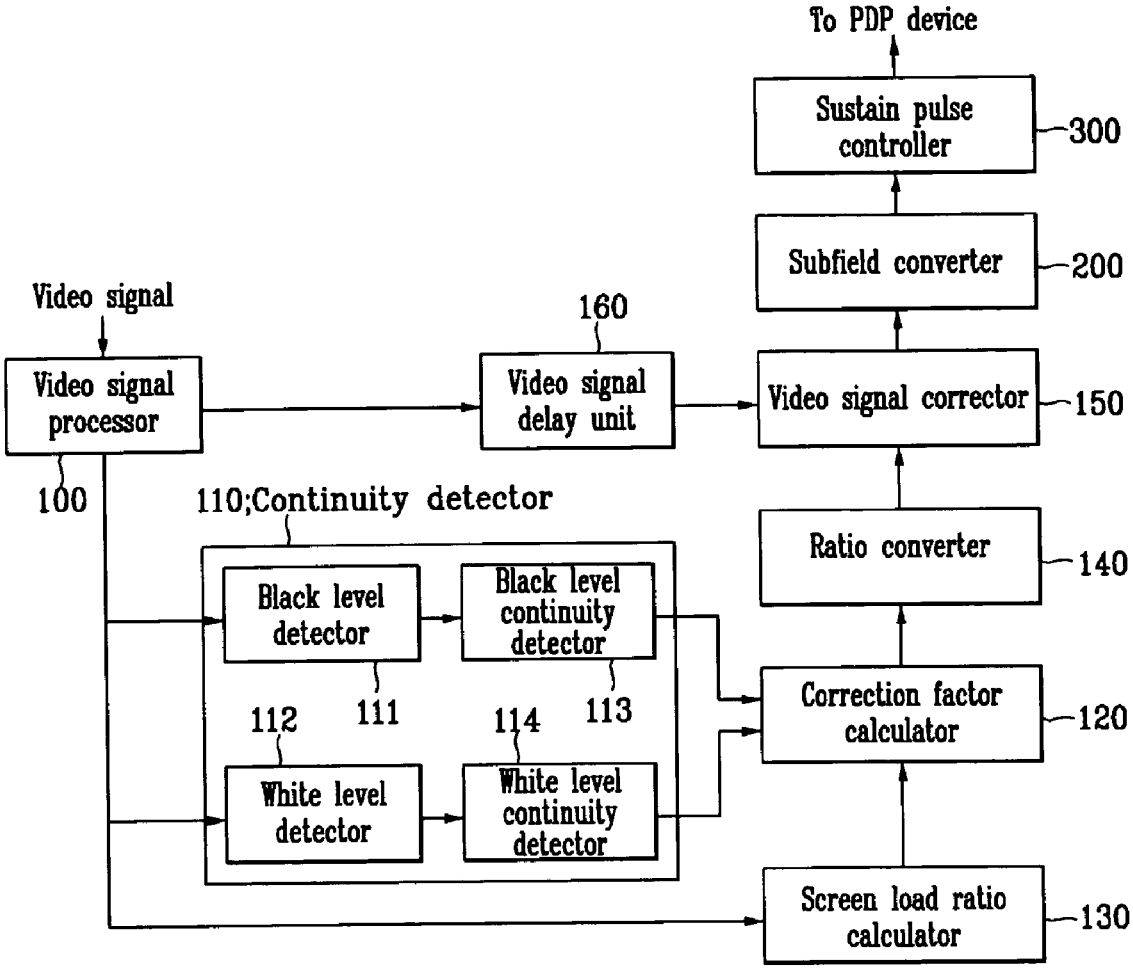
FIG. 1 shows a configuration diagram of a brightness correction circuit according to one embodiment of the present invention.

FIG. 1 shows a configuration diagram of a video display to which a brightness correction circuit is applied according to an exemplary embodiment of the present invention.

The video display 10 includes a brightness correction circuit and a PDP device (not illustrated). As shown in FIG. 1, the brightness correction circuit includes a video signal processor 100, a continuity detector 110, a correction factor calculator 120, a screen load ratio calculator 130, a ratio converter 140, a video signal corrector 150, a video signal delay unit 160, a subfield converter 200, and a sustain pulse controller 300.

The video signal processor 100, the subfield converter 200, and the sustain pulse controller 300 are well-known in the art and will therefore not be described in more detail in this description.

The video signal processor 100 receives video signals, and outputs them to the video signal delay unit 160 and the continuity detector 110. The video signals include digital red/green/blue (RGB) data.

The subfield converter 200 converts the video signals provided by the video signal delay unit 160 through the video signal corrector 150 into SF formats, and outputs them to the sustain pulse controller 300.

The sustain pulse controller 300 controls the number of sustain pulses output to the display according to the video signals input by the subfield converter 200 through the video signal delay unit 160 and the video signal corrector 150.

The continuity detector 110 receives the video signals from the video signal processor 100, and detects cases in which signal level values are greater or less than a predetermined value for a number of consecutive measurements.

In more detail, the continuity detector 110 includes a black level detector 111, a white level detector 112, a black level continuity detector 113, and a white level continuity detector 114.

The black level detector 111 determines pixels which have signal level values less than the predetermined value to be black from among the input video signals.

The white level detector 112 determines pixels which have signal level values greater than the predetermined value to be white from among the input video signals.

The black level continuity detector 113 receives determination results from the black level detector 111, and detects the continuity of the black for a predetermined number of pixels. In more detail, the black level continuity detector 113 detects the cases in which the black is continuous for a predetermined number of pixels or lines in the horizontal or vertical direction with respect to the video signals.

The white level continuity detector 114 receives determination results from the white level detector 112, and detects the continuity of the white for a predetermined number of pixels. In more detail, the white level continuity detector 114 detects the cases in which the white is continuous for a predetermined number of pixels or lines in the horizontal or vertical direction with respect to the video signals.

The correction factor calculator 120 calculates a correction factor according to the ratio between the number of pixels which the continuity detector 110 determines are greater than the predetermined value to the pixels which are less than the predetermined value. In more detail, the correction factor calculator 120 calculates a correction factor for controlling amplification rates (gains) of the signal level values of the video signals and outputs it to the ratio converter 140 according to the ratio of the pixels detected by the black level continuity detector 113 and the ratio of the pixels detected by the white level continuity detector 114.

The screen load ratio calculator 130 calculates a whole screen load ratio of the whole screen according to the signal level values of the total pixels of one field.

In this instance, the whole screen load ratio is defined by integrated values of the brightness of the whole screen or the number of sustain pulses. The screen load ratio calculator 130 integrates the signal level values of the video signals by one field, and outputs the whole screen load ratio of the whole screen to the correction factor calculator 120. As the whole screen load ratio is increased, the correction factor calculator 120 controls the correction factor to reduce the brightness of the whole screen or the number of sustain pulses.

That is, the correction factor in this embodiment is calculated according to the ratio between the pixels greater than the predetermined value to the pixels less than the predetermined value, and also according to the whole screen load ratio. In more detail, the correction factor calculator 120 receives outputs from the black level continuity detector 113, the white level continuity detector 114, and the screen load ratio calculator 130, and calculates a correction factor for correcting the gain of the video signals following a predetermined table according to the ratio of the white and black. In this instance, the correction factor calculator 120 controls the calculated correction factor to be less than 1 (to approach 1) and outputs it to the ratio converter 140 according to the load ratio of the whole screen obtained from the screen load ratio calculator 130.

The ratio converter 140 receives the correction factor from the correction factor calculator 120, and controls it. For example, the ratio converter 140 controls the correction factor to be less than 1 (to approach 1) according to the horizontal position on the screen. That is, the ratio converter 140 gradually changes the correction factor which is input according to the horizontal position on the screen to thus modify the balance of the correction factor in the right or left direction.

The video signal delay unit 160 delays the video signals input by the video signal processor 100 by the number of consecutive pixels or consecutive lines in the horizontal or vertical direction detected by the black level continuity detector 113 or the white level continuity detector 114, and outputs delayed video signals to the video signal corrector 150.

The video signal corrector 150 receives the correction factor through the correction factor calculator 120 and the ratio converter 140 according to the ratio between the pixels detected to be greater than the predetermined value to the pixels detected to be less than the predetermined value The video signal corrector 150 then multiplies the correction factor by the video signals input by the video signal processor 100 (through the video signal delay unit 160), corrects signal level values of the video signals, and outputs them to the PDP-using display (through the subfield converter 200 and the sustain pulse controller 300.)

An operation of the brightness correction circuit according to the an embodiment of the present invention will now be described. When video signals are input to the video signal processor 100, the video signals are delayed, by a delay time generated by the continuity detector 110, in the video signal delay unit 160, and are output to the video signal corrector 150.

In this instance, the continuity of the black level and that of the white level are detected by the continuity detector 110, and they are output together with the whole screen load ratio output by the screen load ratio calculator 130 to the correction factor calculator 120.

For example, when the pixels corresponding to the black are provided in the video signals, the black level detector 111 outputs '1' so as to indicate the pixels are black. The pixels which are not black are defined to be '0.' In this case, since the video signals have noise, the black pixels which appear to have no noise sometimes include a large amount of noise. If the state of 0 is defined to be a decision reference to determine the black state, it results in the fact that most pixels are not black. Accordingly, determination of the black state comes to have some margins, and it is taken into consideration to determine the pixels which are less than a predetermined threshold value, such as 16/255, to be black.

In another point of view, it is determined according to the configuration and magnitude of the circuits and required performance to determine the case in which the RGB colors are less than a predetermined number to be black or determine the case in which the value of the brightness component Y converted by Equation 1, below, from among the RGB colors is less than a predetermined value to be black.

$$0.30R+0.59G+0.11B=Y \qquad \text{Equation 1}$$

Next, the black level continuity detector 113 counts the consecutive number of the black pixels detected by the black level detector 111, and outputs the number of pixels to the correction factor calculator 120 when the number is consecutive more than a predetermined number, for example, ten pixels (dots).

When the pixels are consecutive but not more than the predetermined number, the black level continuity detector 113 does not output the pixel number in order to prevent the erroneous operation in which the pixels which are not black are determined to be black because of the influence of the noise and a further number of black pixels than the real black pixels is counted.

Figure 2:
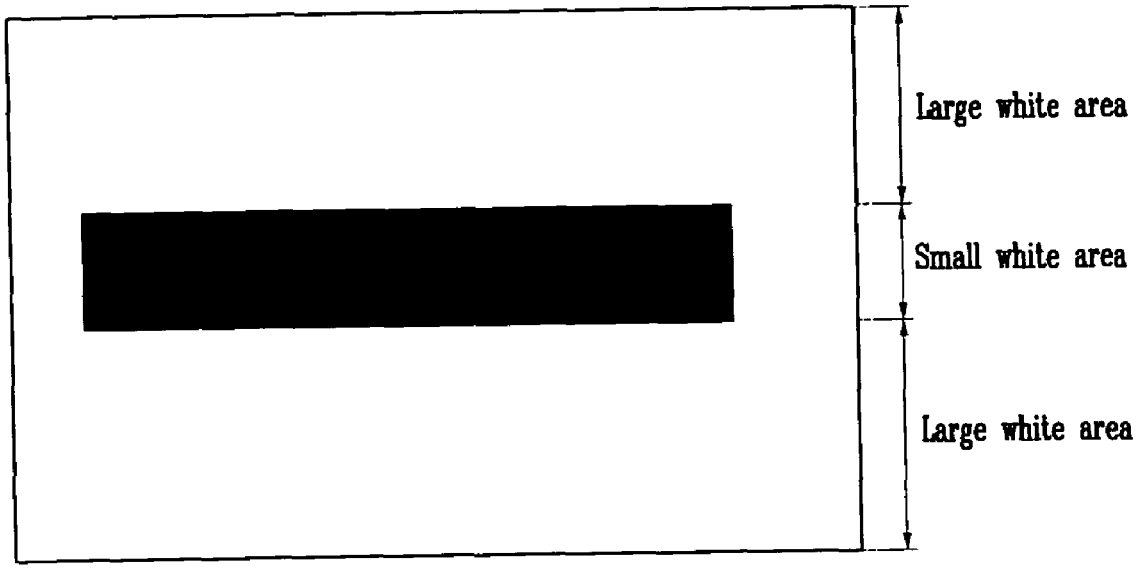
FIG. 2 shows an edge pattern at which a brightness difference is generated.

Also, when the line-based continuity in the vertical direction as well as the horizontal direction is detected, an edge where a brightness difference is generated in a specific pattern can be detected. FIG. 2 shows an example of such a pattern in which a window with black pixels is provided on the background with white pixels.

For example, when the predetermined consecutive number of lines is ten lines, the brightness difference between the large white area and the small white area can be detected.

Next, the white level detector 112 determines the cases of greater than a predetermined threshold value, such as, 240/255 to be white in a like manner of the black level detector 111, and outputs the pixel to be '1,' for example. In this instance, it can be determined whether each pixel is white by using the RGB representation or the Y representation.

The white level continuity detector 114 detects the continuity of the white in a like manner of the black level continuity detector 113, determines the pixels to be white when they are found to be consecutive for more than a predetermined number, and outputs the pixel number to the correction factor calculator 120.

The screen load ratio calculator 130, in temporal parallel with the continuity detector 110, integrates the signal level values of the pixels by one field irrespective of black or white states of the respective pixels, and outputs integrated values to the correction factor calculator 120.

The information on the consecutive number of the black pixels output by the black level continuity detector 113, the consecutive number of the white pixels output by the white level continuity detector 114, and the integrated values of the signal level values of the pixels of one field output by the screen load ratio calculator 130 is provided to the correction factor calculator 120.

The correction factor calculator 120 determines the correction factor output by the ratio converter 140 according to the information.

Figure 3:
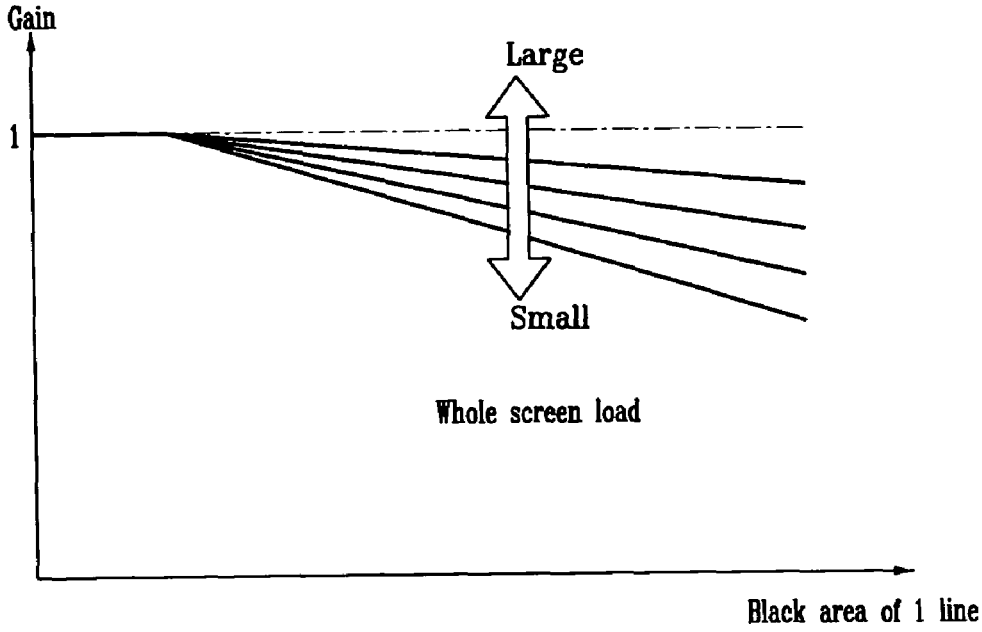
FIG. 3 shows a correction factor determination curve used for calculating correction factors.

FIG. 3 shows an example of a correction factor determination curve used for calculating correction factors where the horizontal axis represents areas occupied by the black pixels on one horizontal line, and the vertical axis indicates correction factors (gains) of video signals.

When the consecutive number of the black pixels is increased, the brightness rises as much as the load is lightened. Accordingly, the brightness is reduced by lowering the gain of the video signal below 1.

To establish a reference value of the gain, the brightness of the part on which the brightness difference is generated is measured. Then, the gain is established with a value that eliminates the brightness difference, for example, 0.95 at the minimum. Then, the correction factor determination curve of FIG. 3 is determined.

In this instance, this phenomenon is very distinctive at the white peak on one horizontal line. Namely, white pixels are consecutive for more than a predetermined threshold value, and the number of black pixels are steeply varied for each line as shown in FIG. 2. Therefore, the ratio between the pixels detected by the black level continuity detector 113 and the pixels detected by the white level continuity detector 114 exceeds a predetermined threshold value.

Accordingly, when a small number of, or no, pixels are output by the white level continuity detector 114, it is considered to suppress unnecessary gain control by terminating processes by the video signal corrector 150, the ratio converter 140, the correction factor calculator 120, and the screen load ratio calculator 130 starting from the one with the least black pixels for each line.

Figure 4:
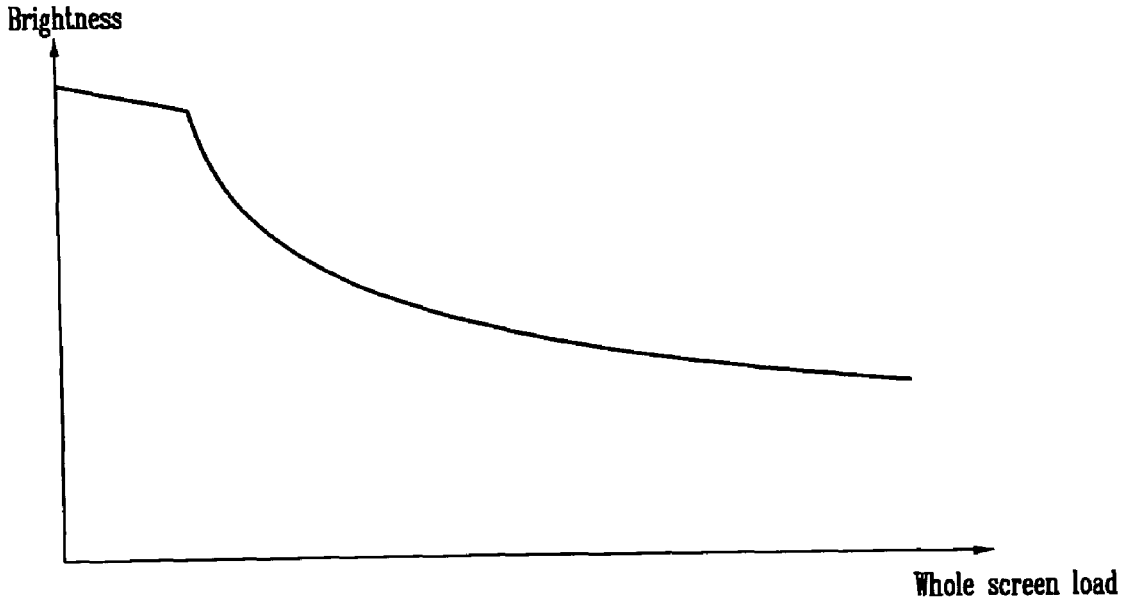
FIG. 4 shows a brightness control characteristic curve according to the load of the total screen.

However, functions for reducing the number of sustain pulses and reducing the brightness, for the purpose of reducing power consumption when the total load of the screen is increased, are frequently provided to the PDP. FIG. 4 shows one example of a control characteristic in which the brightness is lowered when the load ratio is increased.

Figure 6:
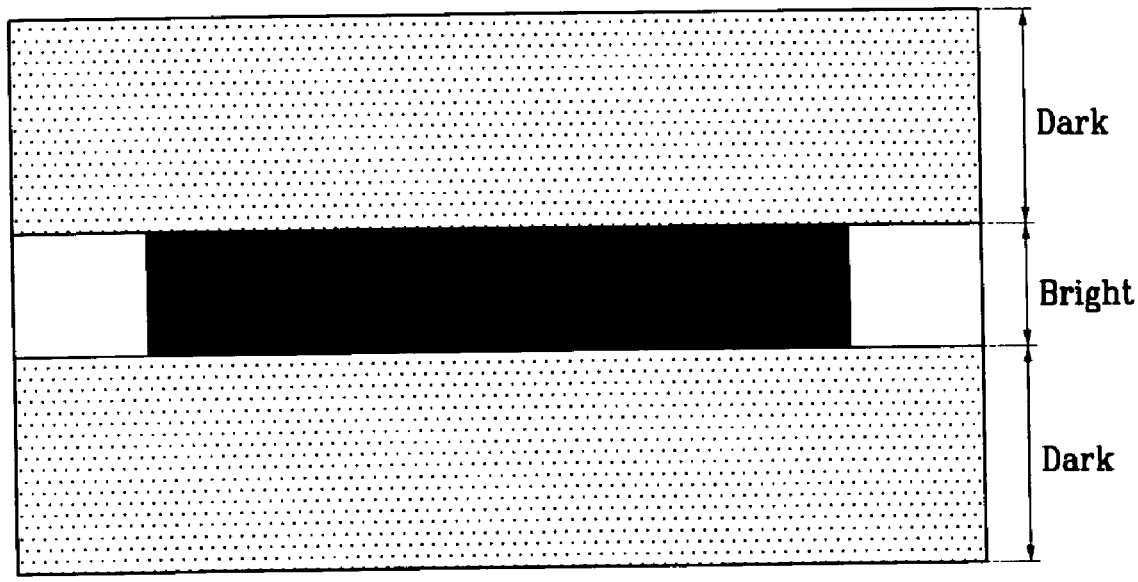
FIG. 6(Prior Art)
FIG. 6 shows a pattern of coexisting places where the brightness is degraded and where it is not degraded.
Figure 7:
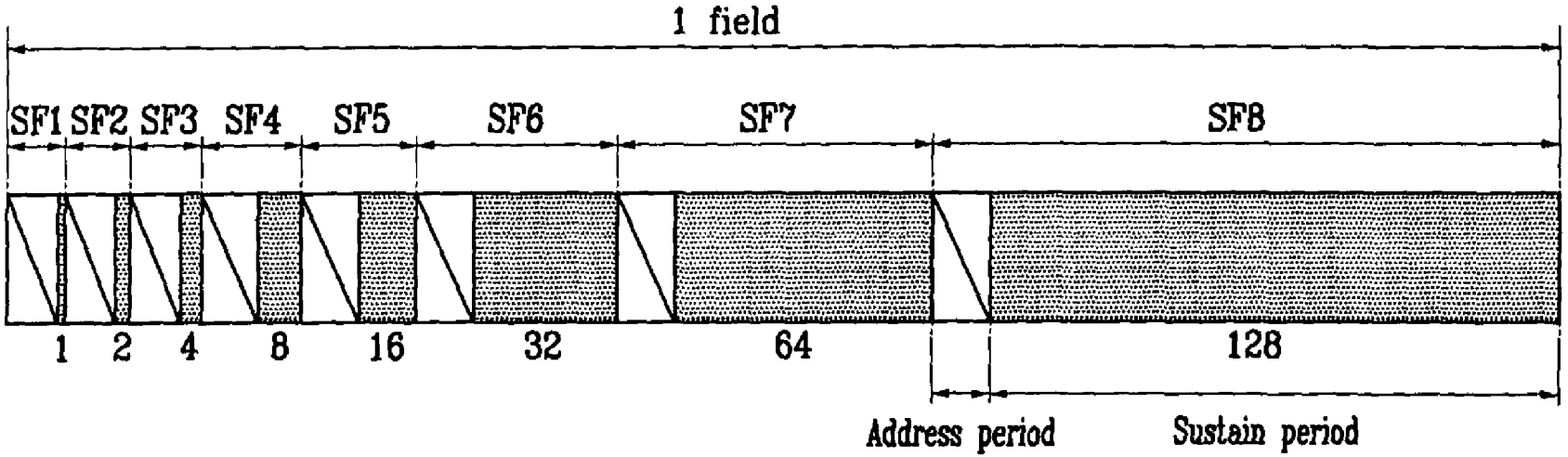
FIG. 7(Prior Art)
FIG. 7 shows a conventional subfield sequence.
Figure 8:
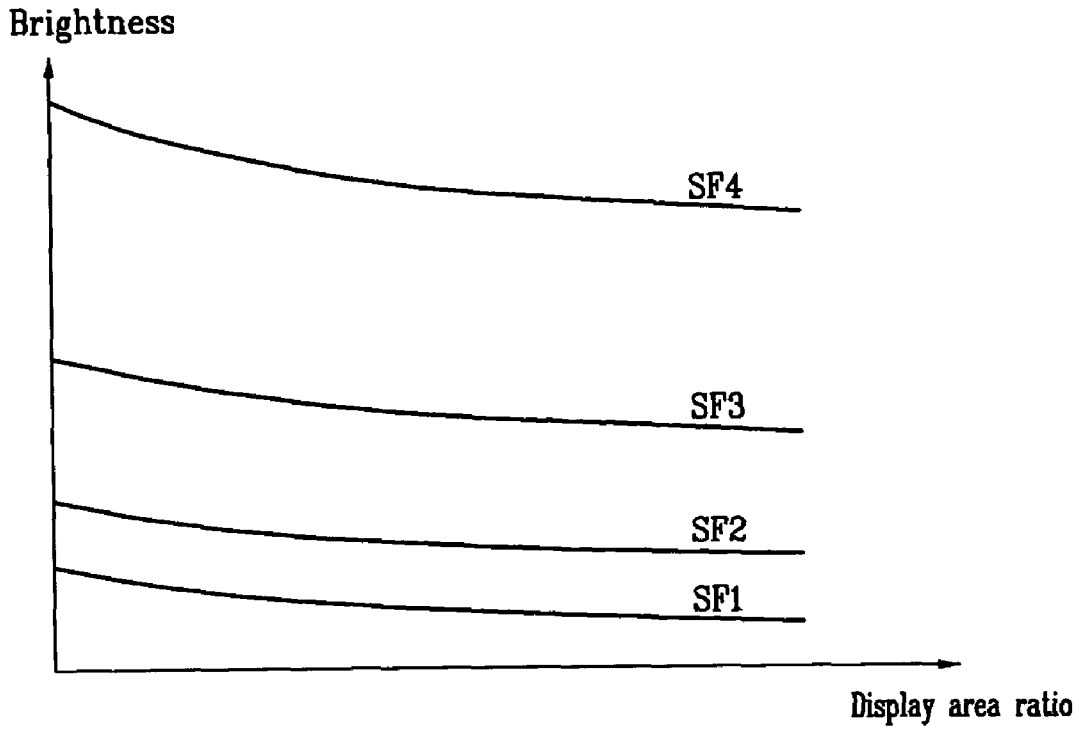
FIG. 8(Prior Art)
FIG. 8 shows lowered brightness as the display area ratio is increased for a conventional subfield sequence.
Figure 9:
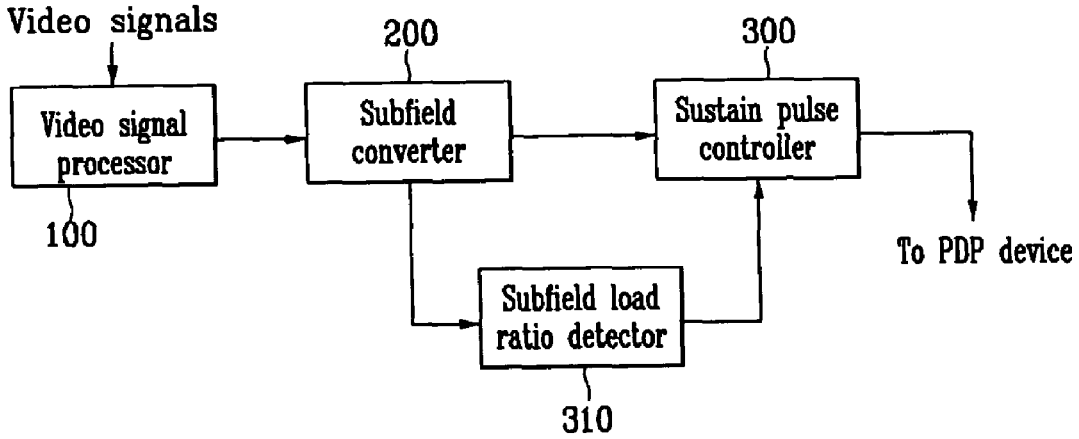
FIG. 9(Prior Art)
FIG. 9 shows an example of a conventional brightness correction circuit.

While the load ratio is increased and the brightness is lowered, the total brightness is lowered, and hence, it is difficult to determine that the phenomenon shown in FIG. 6 is alleviated. Therefore, as shown by the arrow in FIG. 3, the correction factor calculator 120 establishes the correction factor to be less than 1 as the whole screen load ratio is decreased according to the whole screen load ratio output by the screen load ratio calculator 130, and establishes it to be close to 1 as the whole screen load ratio is increased.

The correction factor calculated (established) by the correction factor calculator 120 is input to the ratio converter 140. Brightness lowered ratios can be different on the right and the left of the PDP screen because of the difference of the circuit configuration. If the same correction factor is applied to the right and left, they are not in balance. Hence, the ratio converter 140 multiples the ratio factor which is varied according to the position on the screen such as the solid line or the dotted line by the correction factor output by the correction factor calculator 120 to thus correct the imbalance between the right and the left.

Figure 5:
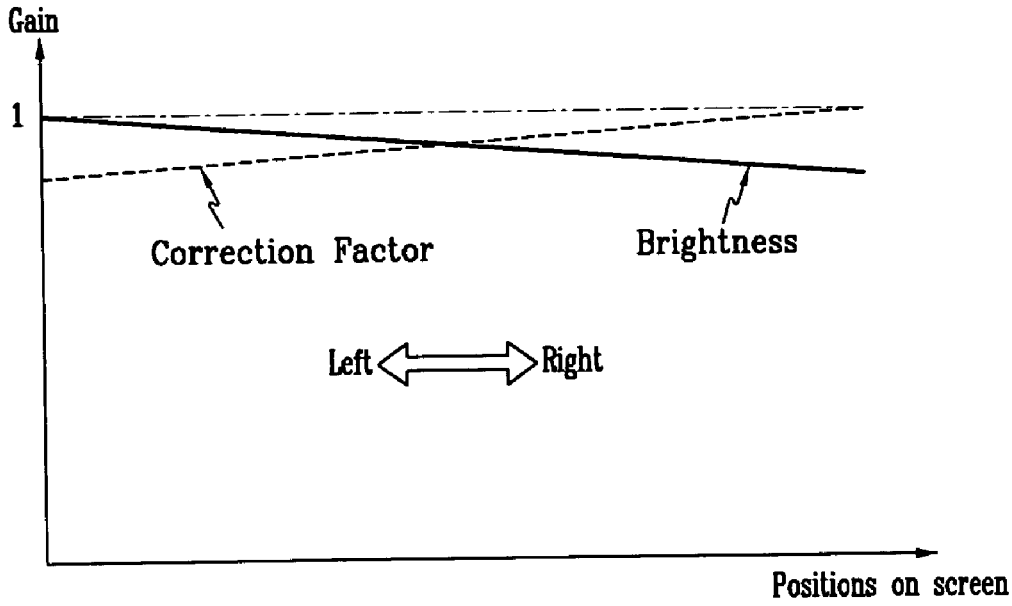
FIG. 5 shows a ratio factor determination curve used for calculating ratio factors.

FIG. 5 shows an example of the ratio factor determination curve used for calculating the ratio factor where the horizontal axis represents relative positions (e.g., an n-th pixel from the left on the screen) of the pixels on the screen (video signals for one field) of a display, and the vertical axis indicates gain (correction factors) of the video signals.

When the pixels on the right side of the screen have higher brightness (lower gain) than the pixels on the left side thereof, a control process can be performed so as to eliminate this. That is, to allow the gain of the right side of the screen to be relatively closer to 1 than the gain of the left side thereof (to be relatively less than 1).

The video signal delay unit 160 delays the video signal by the delay time up to determination of the correction factor including signal delays caused by detection of the continuity by the black level continuity detector 113 and the white level continuity detector 114, and outputs them to the video signal corrector 150.

The video signal corrector 150 refers to a lookup table which shows a corresponding relation between the correction factor and the gain, and changes the gain of the video signal for each line according to the correction factor output by the correction factor calculator 120 through the ratio converter 140. In more detail, the video signal corrector 150 multiplies the video signals input by the video signal delay unit 160 by the gain generated by referring to the lookup table, and outputs result signals to the PDP device (through the subfield converter 200 and the sustain pulse controller 300.)

Thus, the black level continuity detector 113 and the white level continuity detector 114 detect the amount of black signals (a consecutive number) and the amount of white signals (a consecutive number) for each line in the brightness correction circuit according to the embodiment described, and a steep difference provided between the lines is considered to have the brightness lowered, and a control for reducing the brightness is performed on the part where the brightness is not lowered to perform a correction process.

Therefore, the deviation of the brightness, which is generated when the area ratios of the white display for respective lines are different and the load ratios of the respective SFs are not different, is reduced.

Also, the load ratios of the total screen are concurrently detected and the amount of correction is controlled according to the detection in the brightness correction circuit. Therefore, the deviation of brightness is reduced when the peak brightness is varied by the load of the total screen.

As described, video signals are provided, the video signals which are consecutively greater/less than a predetermined value for a predefined number of pixels are detected from among the whole video signals, correction factors calculated according to the ratio between a ratio of pixels of the signal level values detected to be greater than the predetermined value and a ratio of pixels of the signal level values detected to be less than the predetermined value are multiplied, and accordingly, the signal level values of the video signals are corrected.

Therefore, since the signal level values are corrected by reflecting the ratio of the consecutive white pixels and black pixels, the deviation of brightness caused when the area ratio of the white display for each line is different and the load ratio for each SF is not different.

Although exemplary embodiments of the present invention have been described in detail hereinabove, it should be clearly understood that many variations and/or modifications of the basic inventive concept taught herein, which may appear to those skilled in the art, will still fall within the spirit and scope of the present invention, as defined in the appended claims.

What is claimed is:

1. A plasma display panel brightness correction circuit comprising:

a continuity detector for receiving video signals and detecting those of the video signals having signal level values which are consecutively greater than or less than a predetermined value; and a video signal corrector for calculating correction factors according to a ratio between a first number and a second number, the first number being a number of pixels detected to have signal level values greater than the predetermined value by the continuity detector and the second number being a number of pixels detected to have signal level values less than the predetermined value by the continuity detector, and correcting signal level values of the video signals in accordance with the correction factors, wherein the video signal corrector is configured to increase values of the correction factors if a screen load ratio of the video signals increases.

2. The circuit of claim 1, wherein the continuity detector comprises:

a first gray level detector for determining a pixel with a signal level less than the predetermined value to be a first gray level;

a first gray level continuity detector for receiving determination results from the first gray level detector, and detecting a case in which the first gray level is consecutive for a predetermined number of pixels;

a second gray level detector for determining a pixel with a signal level greater than the predetermined value to be a second gray level and outputting determination results; and a second gray level continuity detector for receiving the determination results from the second gray level detector, and detecting a case in which the second gray level is consecutive for a predetermined number of pixels.

3. The circuit of claim 2, wherein the first gray level continuity detector is configured to detect the case in which the first gray level is consecutive for the predetermined number of pixels in at least one of a horizontal direction or a vertical direction, and the second gray level continuity detector is configured to detect the case in which the second gray level is consecutive for the predetermined number of pixels in the at least one of the horizontal direction or the vertical direction.

4. The circuit of claim 3, wherein the video signal corrector is configured to correct signal level values of the video signals which are delayed by the number of consecutive pixels detected by at least one of the first gray level continuity detector or the second gray level continuity detector.

5. The circuit of claim 2, wherein the first gray level continuity detector is configured to detect a case in which the first gray level is consecutive for a predetermined number of lines in at least one of a horizontal direction or a vertical direction, and the second gray level continuity detector is configured to detect a case in which the second gray level is consecutive for a predetermined number of lines in the at least one of the horizontal direction or the vertical direction.

6. The circuit of claim 5, wherein the video signal corrector is configured to correct signal level values of the video signals which are delayed by the number of consecutive lines detected by at least one of the first gray level continuity detector or the second gray level continuity detector.

7. The circuit of claim 1, wherein the video signal corrector is configured to correct the signal level of the video signal according to a screen load ratio calculated according to a signal level of the total pixels of one field.

8. The circuit of claim 7, wherein the correction factors are additionally calculated according to the whole screen load ratio.

9. The circuit of claim 1, wherein the correction factors are additionally calculated according to a screen position of a pixel which is corrected.

10. A plasma display panel brightness correction method comprising:

receiving video signals for pixels and detecting those of the video signals which are consecutively greater or less than a predetermined value for a predetermined number of pixels;

calculating correction factors according to a ratio between a first number and a second number, the first number being a number of pixels with signal level values detected to be greater than the predetermined value and the second number being a number of pixels with signal level values detected to be less than the predetermined value, wherein values of the correction factors are increased if a screen load ratio of the video signals increases; and correcting the signal level values of the video signals in accordance with the correction factors.

11. The method of claim 10, wherein detecting the video signals comprises:

determining pixels with signal level values less than the predetermined value to have a first gray level;

detecting a first case in which the pixels having the first gray level are consecutive for a predetermined number of pixels;

determining pixels with the signal level values greater than the predetermined value to have a second gray level;

detecting a second case in which the pixels having the second gray level are consecutive for a predetermined number of pixels; and detecting the pixels in at least one of the first case or the second case.

12. The method of claim 11, wherein detecting the pixels comprises:

detecting a case in which the pixels having the first gray level are consecutive in at least one of the horizontal direction or the vertical direction for a predetermined number of pixels, and detecting a case in which the pixels having the second gray level are consecutive in at least one of the horizontal direction or the vertical direction for a predetermined number of pixels.

13. The method of claim 12, further comprising delaying video signals by the number of consecutive pixels in at least one of the horizontal direction or the vertical direction and correcting the signal level values of the delayed video signals.

14. The method of claim 11, wherein detecting the location of the pixels comprises:

detecting a case in which the pixels having the first gray level are consecutive in at least one of the horizontal direction or the vertical direction for a predetermined number of lines, and detecting a case in which the pixels having the second gray level are consecutive in at least one of the horizontal direction or the vertical direction with respect to the video signals for a predetermined number of lines.

15. The method of claim 14, further comprising delaying video signals by the number of consecutive lines in at least one of the horizontal direction or the vertical direction and correcting the signal level values of the delayed video signals.

16. The method of claim 10, wherein the signal level values of the video signals are corrected according to a screen load ratio of the screen calculated according to the signal level values of the pixels of one field.

17. The method of claim 16, wherein the correction factors are additionally calculated according to the screen load ratio.

18. The method of claim 10, wherein the correction factors are calculated according to a relative position of the pixel which is corrected on a screen.

19. A video display device using a plasma display panel comprising:

a continuity detector for receiving video signals and detecting the video signals having signal level values which are greater than or less than a predetermined value for a predetermined number of consecutive pixels;

a video signal corrector for calculating correction factors according to a ratio between a first number and a second number, the first number being a number of pixels with signal level values detected to be greater than the predetermined value by the continuity detector and the second number being a number of pixels with signal level values detected to be less than the predetermined value by the continuity detector, and correcting signal level values of the video signals in accordance with the correction factors; and a display for displaying video according to video signals output by the video signal corrector, wherein the video signal corrector is configured to increase values of the correction factors if a screen load ratio of the video signals increases.

20. A video display method using a plasma display panel comprising:

receiving video signals and detecting the video signals having signal level values which are greater than or less than a predetermined value for a predetermined number of consecutive pixels;

calculating correction factors according to a ratio between a first number and a second number, the first number being a number of pixels with signal level values detected to be greater than the predetermined value and the second number being a number of pixels with signal level values detected to be less than the predetermined value, wherein values of the correction factors are increased if a screen load ratio of the video signals increases;

correcting the signal level values of the video signals in accordance with the correction factors; and displaying video according to the corrected video signals.

* * * * *